US007269919B2

(12) United States Patent
Neumann

(10) Patent No.: US 7,269,919 B2
(45) Date of Patent: Sep. 18, 2007

(54) HAMMER DISARMER FOR REPETITION RIFLES OPERATED BY ALTERNATE LINEAR MOVEMENT OF THE FRONTAL ACTIONING FORE-END

(75) Inventor: Ingo Alberto Neumann, Porto Alegre (BR)

(73) Assignee: Forjas Tauras S.A., Porto Alegre (BR)

( * ) Notice: Subject to any disclaimer, the term of this patent is extended or adjusted under 35 U.S.C. 154(b) by 73 days.

(21) Appl. No.: 11/018,002

(22) Filed: Dec. 21, 2004

(65) Prior Publication Data

US 2006/0168867 A1 Aug. 3, 2006

(51) Int. Cl.
*F41A 17/26* (2006.01)

(52) U.S. Cl. ..... 42/70.08; 42/70.01; 42/70.11

(58) Field of Classification Search ..... 42/70.01, 42/70.08, 70.06, 70.11
See application file for complete search history.

(56) References Cited

U.S. PATENT DOCUMENTS 273,070 A * 2/1883 Hart ..... 42/70.08
3,670,442 A * 6/1972 Kennedy et al. ..... 42/70.08
4,322,906 A * 4/1982 Civolani ..... 42/70.06
5,208,406 A * 5/1993 Badali ..... 42/70.08
5,335,437 A * 8/1994 Andersen ..... 42/70.08
5,910,003 A 6/1999 Kleinpaul
6,347,473 B1 * 2/2002 Buffoli ..... 42/66
6,460,282 B1 * 10/2002 Bustos ..... 42/66
6,523,294 B2 * 2/2003 Curry et al. ..... 42/66
6,862,830 B2 * 3/2005 Pagnoncelli ..... 42/70.08

* cited by examiner

*Primary Examiner*—Stewart Knox
(74) *Attorney, Agent, or Firm*—Volpe & Koenig PC

(57) ABSTRACT

Hammer disarmer for rifles, constituted of a cylindrical pin lodged in the hammer itself having an operable protruding head over the curved upper surface of the hammer spur, going downwards through a cylindrical portion provided with a frontal plane recess, within which a positioning transverse pin limiting the movements of the disarming axle operates, over which a small return spring lodged within the hole of the hammer also actuates, said hole whose diameter decreases downwards, lodging and guiding the whole elongated portion of the disarmer until its end emerges from the lower plane face of the hammer, where it actuates the disarming lever. If the hammer is armed, a thumb pressure on the actuation head, is sufficient to release the hammer disarmer, which is pushed by the corresponding spring to an interrupted rotation when fitted to the trigger, before the position of percussion. If the hammer is disarmed, it can be simply armed with the thumb to fire the gun, pulling the trigger when desired.

2 Claims, 4 Drawing Sheets

HAMMER DISARMER FOR REPETITION RIFLES OPERATED BY ALTERNATE LINEAR MOVEMENT OF THE FRONTAL ACTIONING FORE-END

FIELD OF THE INVENTION

The invention refers to a safety system for repetition rifles provided, with a tubular magazine for storage, below and parallel to the barrel, of ammunition and, more specifically, to a hammer disarmer for said repetition rifles operated by alternate linear movement of the frontal actioning fore-end (pump action).

BACKGROUND OF THE INVENTION

In repetition rifles that are operated by movements of the frontal fore-end, while there is ammunition in the magazine, an alternate linear movement of the actioning fore-end will be sufficient to eject the fired cartridge case lodged within the chamber, subsequently feeding a new cartridge into the chamber and leaving the hammer armed for the next shot, which will only depend on trigger action.

Transportation and handling of this model of repetition rifles constitutes particularly constant danger, since they are very liable to cause accidental shots. When the user stops firing the rifle, the user must to remember to manually disarm the hammer, simultaneously pressing the trigger. This required safety operation implies a certain risk; the hammer may slips from the finger if it has been lubricated or if the person does not have the required movement coordination.

An example of a safety device corresponds to patent U.S. Pat. No. 5,910,003, by Kleinpaul, which refers to a locking device for guns, more precisely to a locking device that prevents the use of a revolver, a pistol or the like, either by unauthorized or untrained people, for instance children, comprising a cylindrical locking pin housed in a housing cavity made in a suitable part of the revolver, having one operable head portion apparent on the external surface of the revolver and an opposite end portion, and a substantially helicoidal groove cooperating with a retention pin, the device locking the revolver when, upon operation with a suitable key, said locking pin translates inside its housing cavity projecting one of its ends outwards said housing cavity in order to co-operate with the striking surface so that said projected end obstructs hammer striking movement.

The device is locked when one of the two opposite ends of the locking pin is projected out of its respective housing cavity and cooperates with a given striking surface, and otherwise the device is unlocked when none of the two opposite ends of the locking pin is projected out of its respective housing cavity and cooperates with a given striking surface.

Preferentially, said operable head portion apparent from the external surface of the revolver has connective means to engage with a suitable key only, and cooperates with said locking pin. Positioning means are designed to establish the two correct positions that the device can assume, "locked" or "unlocked".

In one preferred embodiment of the referred invention this locking pin is housed in a cavity in the rear portion of the hammer.

In an alternative embodiment of the referred invention, this locking pin is housed in a cavity in the rear upper portion of revolver frame.

SUMMARY

Instead, the object of the present invention is not a lock, but rather a device used to avoid the initially mentioned risk of accidental shots in repetition rifles when a cartridge is housed in the chamber of the barrel and the hammer is armed. The disarming of the hammer is simple and safe, since it only depends on exerting a slight finger pressure on the head of the disarming device that protrudes from the frontal concave portion of the upper face of the hammer. This light and local pressure determines the release of the hammer, whose spring pushes it to the position where its movement is safely interrupted shortly before percussion. To fire the rifle, the user must only arm the hammer with the thumb to its firing position, which is made by the usual slight pressure on the trigger.

DESCRIPTION OF DRAWINGS

The hammer disarming device, object of the invention, will be better understood by the description below with reference to the attached figures, where.

DETAILED DESCRIPTION OF THE PREFERRED EMBODIMENTS

Figure 1:
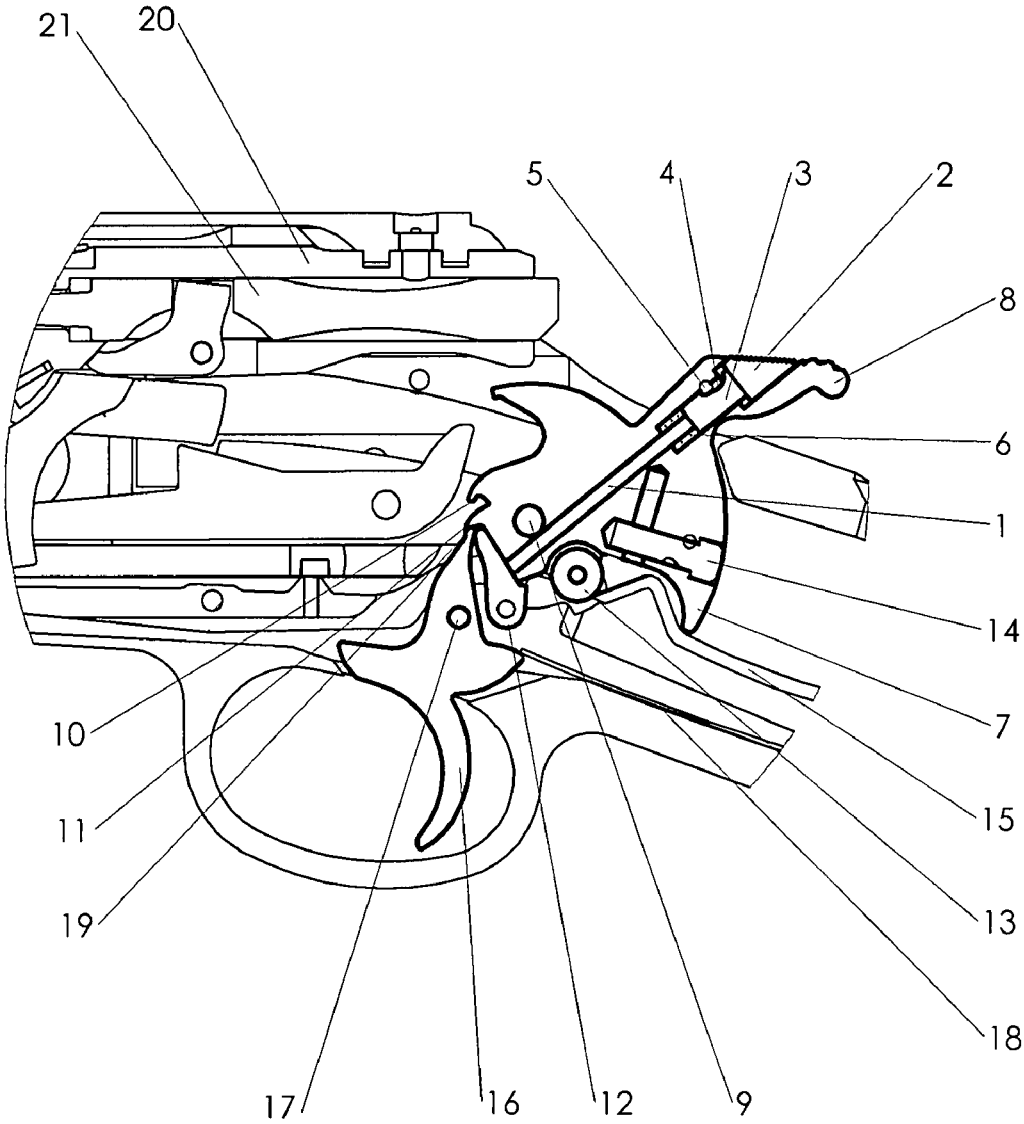
FIG. 1 is a partial sectioned side view of the repetition rifle, restricted to the firing device represented in the armed hammer position.

The safety device is basically constituted of a cylindrical disarming pin formed by three portions of cylindrical section with different diameters. The first one is the actuation head 2, the second a short section 3 with a frontal incision 4 and the third one is the elongated main body 1 with smaller diameter.

The disarming pin is inserted in a hole of the hammer 7 with portions of different diameters, which meet to those of the corresponding portions of the disarming pin. Said hole in the hammer 7 is practically tangent to its turning axis 9.

Before the pin is introduced, a small helicoidal spring 6 is inserted in the portion of the hole with intermediate diameter below the short section 3 of the actuation head 2.

The disarming pin is kept in the correct position in the hammer 7 by the small crosswise pin 5 laterally inserted in the hammer to interact with the plane frontal depression 4 of said pin.

The lower part of the hammer has a plane face, where the lodging hole of the disarming pin 1 emerges and where the lower end can of the disarming pin 1, in this way, act on the upper face of the small disarming lever 12 that is, hinged to the lower back portion of the hammer. In front of and above the edge of the disarming lever, the round face of the hammer is provided with two notches 10 and 11 that interact with the upper edge 19 of the trigger 16 jointed on its axle 17, and that fit in the notches according to the position of the hammer.

As shown in FIG. 1, the hammer 7 is armed by the return movement of the breech bolt 20 or simply by the thumb, acting over its actuation spur 8. In both cases the spring 15 presses the hammer, acting over the roller 13 to the position where the higher edge 19 of the trigger 16 is forced, by the pressure of the corresponding spring 18, to fit into the notch 11 of the hammer 7 against the edge of the disarming lever arm 12.

Figure 2:
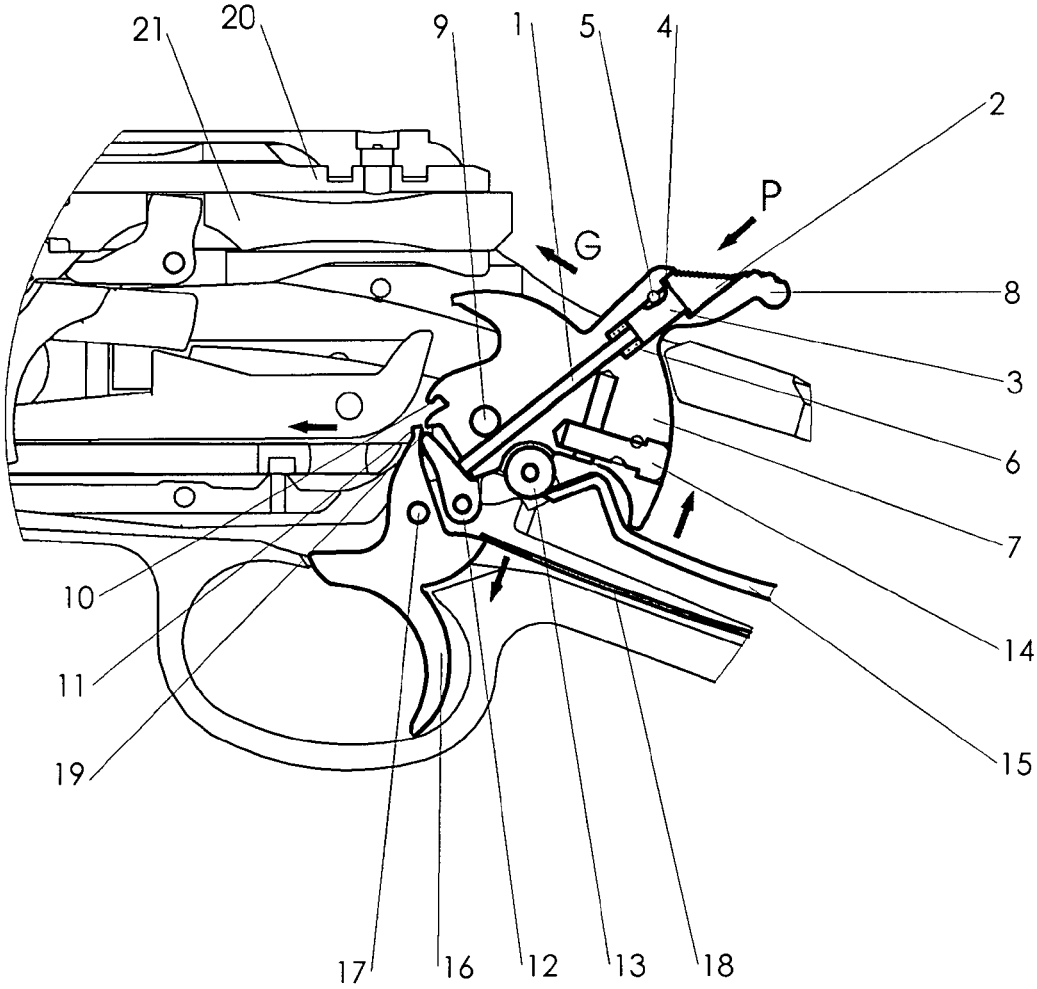
FIG. 2 is the same kind of view with the firing device represented at the start of the hammer disarming operation.

When the curved disarming head 2 is slightly pressed downwards (FIG. 2—arrow P), its short section 3 penetrates more into the corresponding lodging of the hammer 7, pressing the spiral return spring 6 in a movement limited by the interaction between the notch 4 and the corresponding pin 5. This movement downwards of the disarming pin 1 makes its lower edge protrude from the corresponding hole in the lower face of the hammer 7, causing the turning of the disarming lever 12, hinged to the hammer itself. Said rotation of the disarming lever 12 causes its longer arm to push the edge 19 of the trigger 16 out of its notch 11, releasing the hammer 7 in its forward rotation G, pushed by the corresponding spring 15. Said disarming rotation of the hammer 7 (FIG. 3) is interrupted before the percussion position by the fit of the upper edge 19 of the trigger 16, pushed by the spring 18 itself against and into the safety notch 10 of the hammer 7.

Figure 3:
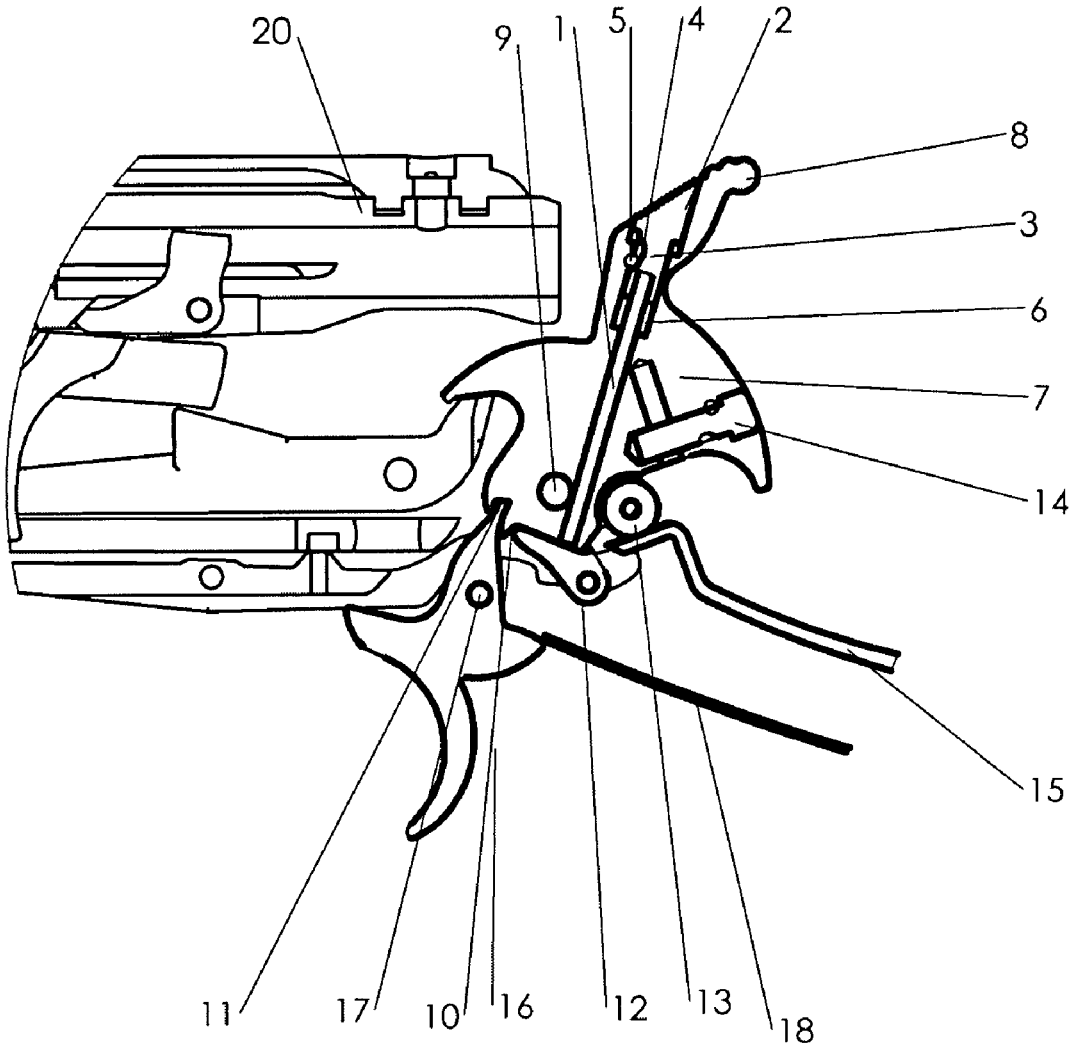
FIG. 3 is the same kind of view with the firing device represented in the position of disarmed hammer and in the safety position.
Figure 4:
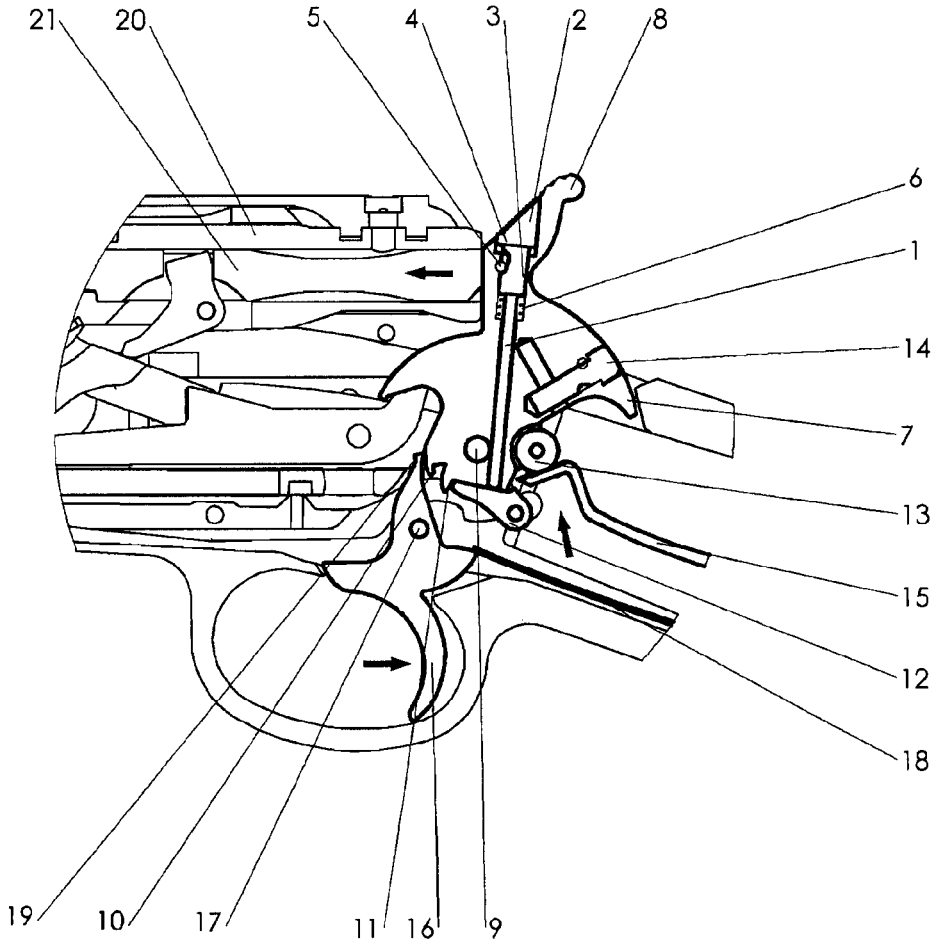
FIG. 4 is the same kind of view with the firing device represented in the position of percussion when the hammer release is commanded by pressing the trigger.
Figure 5:
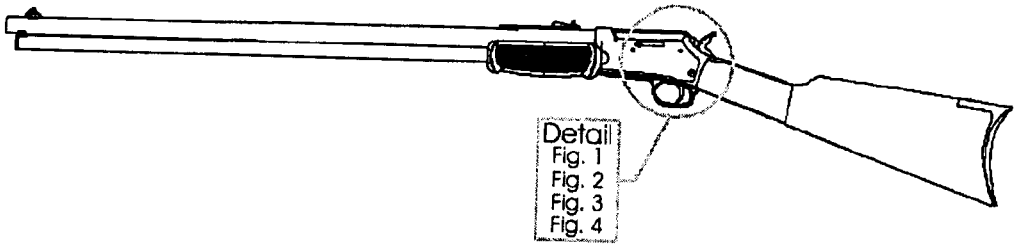
FIG. 5 is a general side view of the repetition rifle.

In FIG. 3, we can clearly see that the frontal portion of the hammer 7 does not reach the back face of the firing pin 21 which projects slightly behind the breech bolt 20, even when the gun has ammunition in the chamber. When the user wants to shoot, the person only needs to manually arm the hammer 7 and then actuate the trigger 16 at the desired moment (FIG. 4).

In all figures, the safety device lock 14 of the hammer 7 is represented in a position that does not interfere with the movement of the hammer and therefore the use of the gun. This lock is solely provided to avoid the use of the gun by unauthorized persons.

When the hammer is armed, the upper edge 19 of the trigger 16 fits into the lower notch 11 of the hammer 7, adjacent to the edge of the disarming lever 12.

The user, intentionally pulling of the trigger 16 to the end of its course, forces its edge 19 to release from its interference with the notches 11 and 10 of the hammer 7, allowing its free rotation under the impulse of the corresponding spring 15 to its impact with the firing pin 21, causing the shot.

What is claimed is:

1. Hammer disarming device for pump action repetition rifles, operated by alternated linear movements of a front actuation fore-end, in which a hammer comprises a lodging hole from an upper actuation face of the hammer to a lower plane face of the hammer, being said lodging hole tangent to a transverse hole of a hammer axle with a variable internal diameter to lodge a disarming pin, said disarming pin comprised of three sections with different dimensions, being the first section an actuation head having a first diameter, whose upper face is curved; the second section having smaller diameter than the first diameter, said second section comprising a plane notch on a frontal face of the second section; and the third section much longer than the first and second sections having the smallest diameter of the three sections, said disarming pin inserted in the lodging hole in the hammer, said lodging hole having a return helicoidal spring disposed therein, a fixing pin acting on the plane notch on the frontal face of the second section, preventing the exiting of the disarming pin from the hammer and limiting its movement, wherein a disarming lever, whose movement is hinged to a lower and back portion of the hammer, and whose lever movement is actuated by a lower end of the disarming pin protruding from the lower plane face of the hammer when the hammer is armed and voluntary pressure is made on the actuation head, said lever in turn pushes an upper edge of a trigger off a first notch of the hammer and allows rotation of the trigger until said upper edge of the trigger fits a second safety notch, preventing accidental firing of the rifle.

2. Hammer disarming device according to claim 1, wherein, while in a disarmed hammer position, it is only necessary to manually arm the hammer in its cocked position to fire the gun by pressing the trigger.

* * * * *

UNITED STATES PATENT AND TRADEMARK OFFICE

CERTIFICATE OF CORRECTION

PATENT NO. : 7,269,919 B2
APPLICATION NO. : 11/018002
DATED : September 18, 2007
INVENTOR(S) : Ingo Alberto Neumann It is certified that error appears in the above-identified patent and that said Letters Patent is hereby corrected as shown below:

On the title page, item [73] delete the assignee name "Forjas Tauras S.A." and insert therefor -- Forjas Taurus S.A. --

Signed and Sealed this

Sixth Day of May, 2008

JON W. DUDAS
*Director of the United States Patent and Trademark Office*